US006858272B2

(12) United States Patent
Squires

(10) Patent No.: US 6,858,272 B2
(45) Date of Patent: Feb. 22, 2005

(54) HORIZONTALLY DRAINING, PRE-ENGINEERED SYNTHETIC TURF FIELD

(76) Inventor: Troy Squires, 9004 Fairway Hill Dr., Austin, TX (US) 78750

( * ) Notice: Subject to any disclaimer, the term of this patent is extended or adjusted under 35 U.S.C. 154(b) by 191 days.

(21) Appl. No.: 09/808,703

(22) Filed: Mar. 14, 2001

(65) Prior Publication Data

US 2002/0132099 A1 Sep. 19, 2002

(51) Int. Cl.[7] ..... A01N 3/00

(52) U.S. Cl. ..... 428/17; 428/15; 428/86; 428/88; 428/92; 428/95; 428/137; 273/DIG. 13

(58) Field of Search ..... 428/17, 15, 86, 428/92, 95, 137, 88; 405/38, 35, 50; 273/DIG. 13

(56) References Cited

U.S. PATENT DOCUMENTS

| | | | | |
|---|---|---|---|---|
| 3,315,408 | A | 4/1967 | Fisher | |
| 3,617,413 | A | 11/1971 | Elbert | |
| 3,940,522 | A | 2/1976 | Wessells | |
| 3,987,648 | A | 10/1976 | Fillmore, Jr. et al. | |
| 4,044,179 | A | 8/1977 | Haas, Jr. | |
| 4,319,468 | A | 3/1982 | Kohl | |
| 4,337,283 | A | 6/1982 | Haas, Jr. | |
| 4,358,939 | A | 11/1982 | Kohl | |
| 4,389,435 | A | 6/1983 | Haas, Jr. | |
| 4,444,815 | A | 4/1984 | Friedrich | 3/1 |
| 4,572,700 | A | 2/1986 | Mantarro et al. | 9/8 |
| 4,665,717 | A | 5/1987 | Atsushi | 35/6 |
| 4,739,603 | A | 4/1988 | Butler | |
| 4,768,897 | A | 9/1988 | Nussbaumer et al. | |
| 5,065,601 | A | 11/1991 | Kaufmann | |
| 5,205,068 | A | 4/1993 | Solomou | |
| 5,462,778 | A | 10/1995 | Ishikawa | |
| 5,489,317 | A | 2/1996 | Bergevin | |
| 5,586,408 | A | 12/1996 | Bergevin | |
| 5,601,886 | A | 2/1997 | Ishikawa et al. | |
| 5,850,708 | A | 12/1998 | Bergevin | |
| 5,901,583 | A | 5/1999 | Kemper et al. | |
| 6,029,397 | A | 2/2000 | Motz et al. | |
| 6,094,860 | A | 8/2000 | Motz et al. | |
| 6,145,248 | A | 11/2000 | Bergevin | 13/8 |
| 6,173,528 | B1 | 1/2001 | Motz et al. | |
| 6,216,389 | B1 | 4/2001 | Motz et al. | |
| 6,221,445 | B1 * | 4/2001 | Jones | 428/17 |
| 6,242,062 | B1 | 6/2001 | de Vries | 13/8 |

FOREIGN PATENT DOCUMENTS

| | | | |
|---|---|---|---|
| DE | 2329975 | 1/1974 | |
| DE | 2248911 | 4/1974 | |
| DE | 3703866 | 8/1988 | |
| EP | 0174755 A1 | 8/1984 | |
| EP | 0154841 | 2/1985 | |
| EP | 0373282 | 12/1988 | |
| EP | 0403008 A1 | 8/1990 | |
| EP | 0452529 A1 | 10/1991 | |
| EP | 0724825 A1 | 8/1996 | |
| FR | 2096340 | 2/1972 | |
| GB | 1320868 | 6/1973 | |
| JP | 59-151813 | 8/1984 | |
| JP | 4-24432 | 2/1992 | |
| NL | 1004656 | 11/1996 | 13/8 |

(List continued on next page.)

*Primary Examiner*—Deborah Jones
*Assistant Examiner*—Abraham Bahta

(57) ABSTRACT

An artificial turf system that includes a base and a turf assembly. The base is readily constructed, at least in part, from naturally occurring ground elements that are present upon initiation of the construction of the base. The base is constructed to include a drainage mechanism that is disposed near the surface of the base. The turf assembly is laid out upon the base and is constructed to pass fluid, e.g., water, therethrough such that the fluid is specifically directed to the drainage mechanism of the base as it moves through the turf assembly. The turf assembly includes a plurality of layers such as an impermeable moisture barrier layer, a drainage layer, a filtering layer, and a turf mat.

20 Claims, 2 Drawing Sheets

FOREIGN PATENT DOCUMENTS

| | | | |
|---|---|---|---|
| WO | WO 92/ 05316 | 4/1992 | ..... 17/20 |
| WO | WO 94/00639 | 1/1994 | |
| WO | WO 98/23817 | 6/1998 | ..... 13/8 |
| WO | WO 99/28557 | 6/1999 | ..... 13/8 |

* cited by examiner

HORIZONTALLY DRAINING, PRE-ENGINEERED SYNTHETIC TURF FIELD

BACKGROUND

1. Field of the Invention

The present invention relates to an improved artificial turf playing field and more particularly to a horizontally draining, pre-engineered synthetic turf field.

2. Description of the Related Art

Artificial turf playing fields have become a common type of field that are used for various activities. These activities include sporting and other types of activities that require a large open space. The fields are sometimes referred to as "playing fields." A primary consideration of artificial turf playing fields is the ability of the field to drain water from sources such as rain or washing. Early fields were constructed over impervious bases and water was left to simply run off the upper turf surface. This type of drainage system often interfered with players on the field. Efforts to create a field that offers more desirable attributes with regard to external effects such as rain have resulted in relatively expensive field construction. This has resulted in hardship when, among other things, small communities desire to install an artificial turf system for their high schools or other modest recreational facilities.

Another drawback to prior art artificial turf systems is the presence of concrete or asphalt beneath the field. This can make the field unsuitable for high impact sports such as football where the players often fall to the ground beneath the force of other players. Injuries may result if the field does not absorb the blows associated with the sport. Concrete and asphalt have also been known to absorb heat and create extremely high temperatures on the playing field.

Many other problems and disadvantages of the prior art will become apparent to one skilled in the art after comparing such prior art with the present invention as described herein.

SUMMARY OF THE INVENTION

Various aspects of the present invention may be realized through an artificial turf system that includes a base and a turf assembly. The base is readily constructed, at least in part, from naturally occurring ground elements that are present upon initiation of the construction of the base. The base is constructed to include a drainage mechanism that is disposed near the surface of the base. The turf assembly is laid out upon the base and is constructed to pass fluid, e.g., water, therethrough such that the fluid is specifically directed to the drainage mechanism of the base as it moves through the turf assembly. The turf assembly includes a plurality of layers such as an impermeable moisture barrier layer, a drainage layer, a filtering layer, and a turf mat.

The impermeable moisture barrier layer is laid upon the base such that the fluid may only pass to the base at predetermined locations that correspond to the drainage mechanism. The drainage layer is laid upon the impermeable moisture barrier layer such that an area is created where fluid is free to pass to the impermeable moisture barrier layer and ultimately to the drainage mechanism of the base. The filtering layer is laid upon the drainage layer and filters out undesirable particles from the fluid as the fluid passes through the filtering layer and into the drainage layer. The area between the filtering layer and the impermeable moisture barrier layer is permanently available whether or not fluid is passing therethrough. The turf mat is laid upon the filtering layer and has grass on an upper surface to give the artificial turf system the appearance of a completely natural grass field.

Different embodiments of the artificial turf system include various combinations of the following elements: the grass of the artificial turf system may be a synthetic material that has been formed to appear like natural grass or the grass could be a mixture of natural and synthetic material to form a layer that appears like a completely natural grass surface; the drainage layer may be a plastic layer having evenly distributed protrusions of the same height, a spring-like distribution of elongate plastic material, or other type of configuration; and the filtering layer may be a woven or non-woven geotextile. It should be noted that the impermeable moisture barrier layer, the filtering layer, and the drainage layer may be positioned separately, as a single unit, or otherwise.

The base of the artificial turf system may be a natural soil alone, or a natural soil that includes at least one of a plurality of stabilizing agents. The stabilizing agent is commonly selected from the group consisting of lime, fly ash, stone, and enzyme, but may be any similar type of agent.

The turf assembly and base combination of the artificial turf system is typically substantially flat in order to provide a playing surface for a plurality of sporting activities.

Various aspects of the present invention may also be found through a method for assembling a pre-engineered synthetic turf system. The method involves the following steps, not necessarily in the following order: forming a base having a drainage system built in for draining fluids away from the pre-engineered synthetic turf system; and laying out a turf assembly upon the base such that fluids contacting the turf assembly pass into the drainage system of the base through various layers of the turf assembly. The various layers of the turf assembly include an impermeable moisture barrier layer disposed upon the base such that fluid passing through the turf assembly reaches the base in certain predetermined areas only; a drainage layer disposed upon the moisture barrier layer that provides an open space for passage of fluid, the open space remaining open even when fluid is not passing therethrough; a filtering layer disposed upon the drainage layer to prevent passage of undesirable particles in the fluid into the drainage layer; and an artificial turf layer having grass on an upper surface. The grass provides the turf assembly with an appearance of a completely natural playing field, and the drainage layer provides support for the artificial turf layer such that the turf assembly has the feel of a completely natural playing field.

The method sometimes depends on the impermeable moisture barrier layer, the drainage layer, and the filtering layer being combined into a single unit that may be rolled out as a single layer. When this is the case, laying out the turf assembly involves rolling the single unit onto the base such that the base is completely covered with the single unit and fluid may flow to the base only through specific predetermined locations in the turf assembly. Then, the method includes rolling the artificial turf layer onto the single unit so that a field is formed that appears similar to a natural grass surface.

Still other aspects of the present invention are realized through a pre-engineered synthetic turf system that includes a base having a drainage system built in for draining fluids away from the pre-engineered synthetic turf system. A turf assembly is laid upon the base such that fluids contacting the turf assembly pass into the drainage system of the base through various layers of the turf assembly. The various layers of the turf assembly include an impermeable moisture barrier layer disposed upon the base such that fluid passing through the turf assembly reaches the base in certain predetermined areas only; a drainage layer disposed upon the impermeable moisture barrier layer that provides an open space for passage of fluid, the open space remaining open even when fluid is not passing therethrough; a filtering layer disposed upon the drainage layer to prevent passage of undesirable particles in the fluid into the drainage layer; and an artificial turf layer having grass on an upper surface, the grass providing the turf assembly with an appearance of a completely natural playing field. The drainage layer provides support for the artificial turf layer such that the turf assembly has the feel of a completely natural playing field.

In some embodiments, the base of the pre-engineered synthetic turf system is formed as a smooth surface with a slightly curved cross section. The drainage layer may be a solid plastic material that is shaped as a plurality of evenly distributed protrusions, each of the plurality of protrusions being of the same height. The drainage layer may also include a conglomeration of elongate plastic material that is distributed across the drainage layer such that the elongate plastic material provides the drainage layer with a uniform height across the pre-engineered synthetic turf system.

Other aspects of the present invention will become apparent with further reference to the drawings and specification which follow.

BRIEF DESCRIPTION OF THE DRAWINGS

A better understanding of the present invention can be obtained when the following detailed description of the drawings is considered in conjunction with the following drawings.

DETAILED DESCRIPTION OF THE DRAWINGS

The present invention provides a horizontally draining, pre-engineered synthetic turf field that is low in cost, easy to install, and used to more easily estimate the cost to install. The synthetic turf field may be used for playing fields such as soccer fields, football fields, field hockey fields, or other outdoor sporting events that require a large field that is open to the weather. The field is particularly desirable when ball roll characteristics are especially important, e.g., soccer games, because of the field's substantially flat cross section and the characteristics of the grass and underlying layers of the field. The field may also have other uses such as an outdoor patio carpet or even a golf driving mat. Other uses are contemplated for the turf field of the present invention and such uses will become apparent to those skilled in the art upon viewing the present disclosure.

Figure 1:
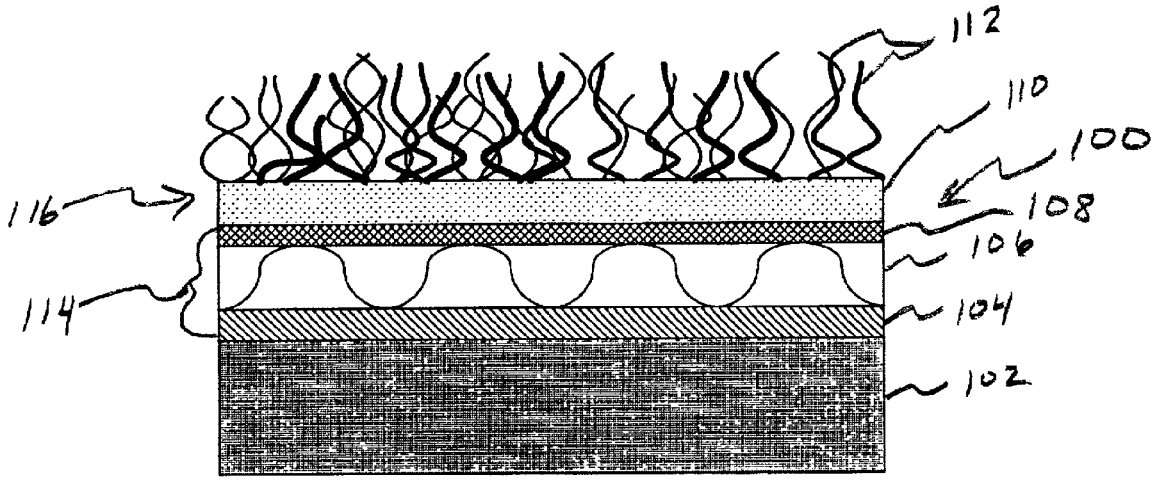
FIG. 1 is a cross sectional block diagram of a portion of an exemplary pre-engineered synthetic turf field that has been constructed in accordance with principles of the present invention.

FIG. 1 is a cross sectional block diagram of a portion of an exemplary pre-engineered synthetic turf field 100 that has been constructed in accordance with principles of the present invention. In general, the field 100 includes various layers beginning with a base 102. The base 102 is the foundation for the turf field 100 and is constructed from materials familiar to those of ordinary skill in the art, e.g., the foundation may be a natural surface, a groomed natural surface, compacted clay, a foamed product, gravel, gravel mixed with soil, standard soil, soil mixed with stabilizing agents such as lime, fly ash cement, stone, crushed stone enzyme, bituminous material, or various combinations thereof, or other type of material that may be formulated inexpensively and efficiently with the materials that are available in the area of field construction, and/or the materials that are easily transported thereto. The base 102 is commonly constructed in such a manner as to be easily formed in the environment where the pre-engineered synthetic turf field 100 is to be constructed.

On top of the base 102 is a moisture barrier layer 104. The moisture barrier layer 104 is an impermeable layer that prevents water or other liquids from passing through to the base 102 except at specific predetermined locations. If water were allowed to be absorbed into the base 102, the base 102, among other things, would gradually erode and weaken with time. Fields of the prior art may be required to be rebuilt when the base 102 becomes faulty. The moisture barrier layer 104 is laid out atop the base 102 in such a way as to prevent undesirable erosion of the base 102.

Atop the moisture barrier layer 104 is a drainage layer 106. The drainage layer 106 is commonly at least partially an impermeable layer with patterned protrusions. The drainage layer 106 may be combined with the moisture barrier layer 104 to form a single layer of the pre-engineered synthetic turf field 100. A filtering layer 108 that allows water to flow through it is placed upon the patterned protrusions of the drainage layer 106. The filtering layer 108 is often made of a non-woven geotextile such as polypropylene but could be made of a woven geotextile as well. Of course, other similar materials may also be used and are contemplated.

An artificial turf mat 110 with grass blades 112 (artificial grass, a combination of artificial and natural grass, or otherwise) is placed on top of the filtering layer 108. This artificial turf mat 110 may be constructed using numerous configurations. For example, the artificial turf mat 110 may be an artificial turf that is not tufted such as the following embodiments.

The artificial turf has two face yarns, one of which is non-textured, and one of which is textured. The artificial turf is preferably knitted, and the non-textured face yarn or pile has a pile height exceeding about 0.6 inch, preferably having a height of at least about 1.0 inch. In use, the textured pile has a height significantly lower than the pile height of the non-textured pile, preferably a pile height of at least 25% less than the pile height of the non-textured pile.

The textured and non-textured pile yarns are knotted together with a stitch-in yarn to form rows of knots in the machine direction of the artificial turf thus made, and lay-in yarns are interlocked with the rows of knots to form a base for the pile yarns. A seal is preferably applied to the backing for additional dimensional stability.

Turf is sometimes constructed using a knitting machine that may contain over 1,000 needles to produce a width of artificial turf of about 15 feet. The assembly process is more complex than tufting. The pile yarn and stitch-in yarn are inserted into a knitting needle. Lay-in yarn is interlocked with the pile and stitch-in yarn through a separate feed mechanism for the machine. Loops of pile fabric are formed and cut by a slitter. The knitted turf is subjected to a finishing operation in which a suitable seal material is applied to penetrate the contact points in the backing and to stabilize the structure. This process is usually accompanied by a heat treatment that stabilizes the fabric and conditions the pile. A fill material such as sand and/or rubber particles is sometimes filled in and around the textured and non-textured pile to about the height of the textured pile. The fill material may be used to create a partially natural, partially synthetic "grass" surface. It is to be understood that various combinations of natural and synthetic grass may be used to construct the artificial turf mat 110.

Advantageously, the protrusions of the drainage layer 106 create room for water to pass through the artificial turf mat 110 and move without interfering activities that are occurring on the surface of the artificial turf mat 110. If the filtering layer 108 were compressed against the moisture barrier layer 104, water would not be able to flow therebetween and, e.g., during a large rainfall, water build up would occur such that water would appear on the surface of the artificial turf mat 110. The protrusions of the drainage layer 106 are spaced such that they provide a uniform support to the turf mat 110. In other words, the turf mat 110 appears and feels substantially solid, even when physical activities occur thereon.

In use, the pre-engineered synthetic turf field 100 provides for drainage of water that may otherwise interfere with the activities on the field. For example, rainfall first contacts the grass blades 112 and passes into the artificial turf mat 110. The water is then absorbed into the filtering layer 108 where objects such as dirt, sand, etc., are filtered out. The filtered water reaches the drainage layer 106 where space is available for the water to move. The space is always available whether or not water is flowing because the filtering layer 106 prevents extraneous objects such as the sand or dirt from clogging the drainage layer 106. A slightly sloped pre-engineered synthetic turf field 100 allows the water to drain from the field 100 into a drainage system (not shown) that removes the water from the area completely.

For convenience of installation, the moisture barrier layer 104, the drainage layer 106 and the filtering layer 108 may be combined into a single unit, i.e., a continuous composite drain (CCD) 114, that may be easily rolled out onto the base 102 during installation. The artificial turf mat 110 and the grass blades 112 may also be combined into a single unit, an artificial turf 116, for easy installation of the pre-engineered artificial turf system 100. Of course, upon viewing the present disclosure, those of ordinary skill in the art of artificial turf systems will appreciate that various combinations of the different turf layers may be used to accommodate different procedural techniques that may be desired for different installation reasons, e.g., for different environmental factors such as hard or soft soil, etc. In addition, different types of material may be used for each of the layers in the pre-engineered artificial turf system 100.

Figure 2:
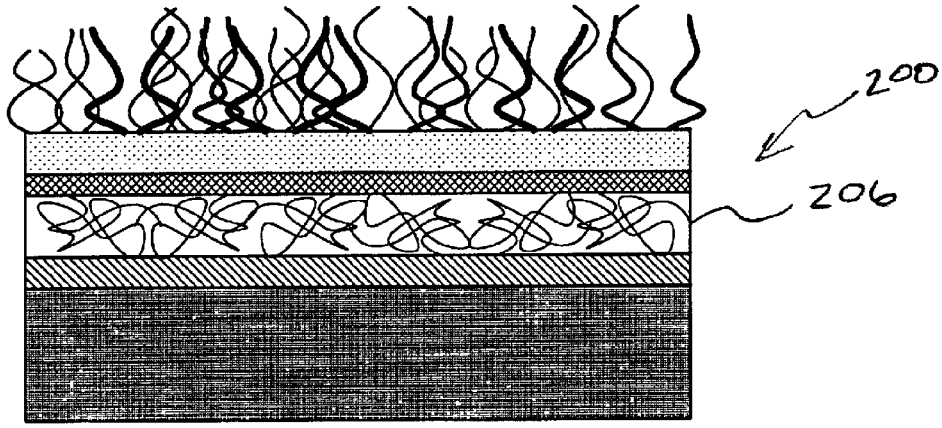
FIG. 2 is a cross sectional block diagram of a portion of another exemplary embodiment of a pre-engineered synthetic turf field that has also been constructed in accordance with principles of the present invention.

FIG. 2 is a cross sectional block diagram of a portion of another exemplary embodiment of a pre-engineered synthetic turf field 200 that has also been constructed in accordance with principles of the present invention. Although the field 200 is very similar to the field 100, a drainage layer 206 is illustrated that is a composite such as plastic that is extruded into long fibers that are gathered to form a continuous support in the field 200. For example, the plastic of the drainage layer 206 is shaped like bedsprings. The drainage layer 206 may provide a softer field 200 than the field 100 and would be preferred if the field 200 is known to be used when certain activities that are conducive to a softer feeling are performed thereon. Of course, other variations of the field 200 are contemplated and the drainage layer 206 could be modified to address the needs of the other field types. For example, a commonly known drainage layer is ENKADRAIN. It is to be understood that the drainage layer 206 may be constructed to offer the option of either a firm or flexible field 200.

Figure 3:
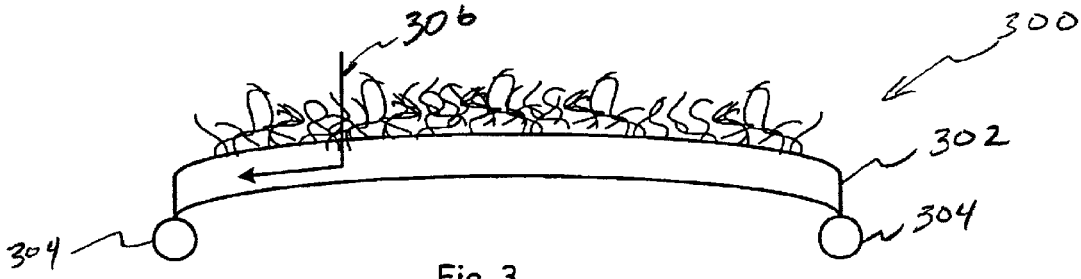
FIG. 3 is a cross sectional block diagram illustrating a representative configuration of a pre-engineered artificial turf system that has been constructed in accordance with principles illustrated in FIGS. 1 and 2.

FIG. 3 is a cross sectional block diagram illustrating a representative configuration of a pre-engineered artificial turf system 300 that has been constructed in accordance with principles illustrated in FIGS. 1 and 2. Although the system 300 is not drawn to scale and the figure cannot be used to obtain the correct field proportions, the operation of the system 300 may be understood from the figure. A field 302 with layers as described in FIGS. 1 and 2 is extended across a base (not pictured). Drainage pipes 304 are placed within the base and positioned such that drainage from the field 302 is collected at each side, end, or otherwise of the field 302. For example, rainfall, represented by arrow 306, contacts the field 302 and drains toward the drainage pipes 304 where it is removed from the playing surface with minimal interference to activities that are occurring upon the field 302. The water is drained as described in detail with relation to FIGS. 1 and 2. Additional drainage pipes (not shown) may be placed across the field 302 in a manner similar to drainage pipes 304 such that water that is collected on the field 302 is removed from the field 302 at numerous locations and the water does not have to travel a great distance to enter into the drainage pipes. The determination of the number of drainage pipes is a factor that may be accounted for during the estimation of the cost of field construction.

Figure 4:
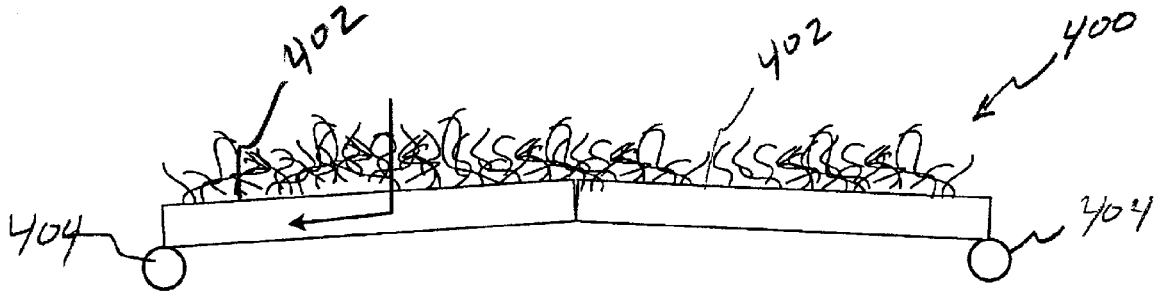
FIG. 4 is a cross sectional block diagram illustrating another representative configuration of a pre-engineered artificial turf system that has been constructed in accordance with principles illustrated in FIGS. 1 and 2.

FIG. 4 is a cross sectional block diagram illustrating another representative configuration of a pre-engineered artificial turf system 400 that has been constructed in accordance with principles illustrated in FIGS. 1 and 2. Unlike the continuous field 302, the system 400 is constructed in two portions 402, each portion 402 being angled downwardly from the longitudinal axis of the center of the field system 400. Again, drainage pipes 404 are located within the base (not shown) at either end of the system 400 and may be further distributed across the field system 400. Of course, other methods are possible to incorporate the pre-engineered synthetic turf fields 100 or 200 into the systems 300 and 400 and variations of the illustrated embodiments are contemplated.

Because the above detailed description is exemplary, when "one embodiment" is described, it is an exemplary embodiment. Accordingly, the use of the word "one" in this context is not intended to indicate that one and only one embodiment may have a described feature. Rather, many other embodiments may, and often do, have the described feature of the exemplary "one embodiment." As used above, when the invention is described in the context of one embodiment, that one embodiment is one of many possible embodiments of the invention.

Notwithstanding the above caveat regarding the use of the words "one embodiment" in the detailed description, it will be understood by those within the art that if a specific number of an introduced claim element is intended, such an intent will be explicitly recited in the claim, and in the absence of such recitation no such limitation is present or intended. For example, in the claims below, when a claim element is described as having "one" feature, it is intended that that element be limited to one and only one of the feature described. Furthermore, when a claim element is described in the claims below as including or comprising "a" feature, it is not intended that the element be limited to one and only one of the feature described. Rather, for example, the claim including "a" feature reads upon an apparatus or method including one or more of the feature in question. That is, because the apparatus or method in question includes a feature, the claim reads on the apparatus or method regardless of whether the apparatus or method includes another such similar feature. This use of the word "a" as a nonlimiting, introductory article to a feature of a claim is adopted herein as being identical to the interpretation adopted by many courts in the past, notwithstanding any anomalous or precedential case law to the contrary that may be found. Similarly, when a claim element is described in the claims below as including or comprising an aforementioned feature (e.g., "the" feature), it is intended that that element not be limited to one and only one of the feature described. Furthermore, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

While particular embodiments of the present invention have been shown and described, based upon the teachings herein, various modifications, alternative constructions, and equivalents may be used without departing from the invention claimed herein. Consequently, the appended claims encompass within their scope all such changes, modifications, etc. as are within the true spirit and scope of the invention. Furthermore, it is to be understood that the invention is solely defined by the appended claims. The above description is not intended to present an exhaustive list of embodiments of the invention. Unless expressly stated otherwise, each example presented herein is a nonlimiting or nonexclusive example, whether or not the terms nonlimiting, nonexclusive or similar terms are contemporaneously expressed with each example. Although an attempt has been made to outline some exemplary embodiments and exemplary variations thereto, other embodiments and/or variations are within the scope of the invention as defined in the claims below.

What is claimed is:

1. An artificial turf system comprising:

a base that is readily constructed, at least in part, from naturally occurring ground elements that are present upon initiation of the construction of the base, the base being constructed to include a drainage mechanism that is disposed near the surface of the base; and a turf assembly that is laid out upon the base and that is constructed to pass fluid therethrough such that the fluid is specifically directed to the drainage mechanism of the base as it moves through the turf assembly, the turf assembly comprising a plurality of layers including:

an impermeable moisture barrier layer that is laid upon the base such that the fluid may only pass to the base at predetermined locations that correspond to the drainage mechanism;

a drainage layer disposed upon the impermeable moisture barrier layer that creates an area where fluid is free to pass to the impermeable moisture barrier layer and ultimately to the drainage mechanism of the base;

a filtering layer disposed upon the drainage layer that filters out undesirable particles from the fluid as the fluid passes through the filtering layer and into the drainage layer, the area between the filtering layer and the impermeable moisture barrier layer being permanently available whether or not fluid is passing therethrough; and a turf mat disposed upon the filtering layer having grass on an upper surface to give the artificial turf system the appearance of a completely natural grass field.

2. The artificial turf system of claim 1 wherein the grass comprises synthetic material that has been formed to appear like natural grass.

3. The artificial turf system of claim 1 wherein the grass comprises a mixture of natural and synthetic material to form a layer that appears like a completely natural grass surface.

4. The artificial turf system of claim 1 wherein the drainage layer comprises a plastic layer having evenly distributed protrusions of the same height.

5. The artificial turf system of claim 1 wherein the drainage layer comprises a spring-like distribution of elongate plastic material.

6. The artificial turf system of claim 1 wherein the filtering layer is a woven geotextile.

7. The artificial turf system of claim 1 wherein the filtering layer is a non-woven geotextile.

8. The artificial turf system of claim 1 wherein the impermeable moisture barrier layer, the filtering layer, and the drainage layer are positioned separately.

9. The artificial turf system of claim 1 wherein the impermeable moisture barrier layer, the filtering layer, and the drainage layer are a single unit.

10. The artificial turf system of claim 1 wherein the base comprises natural soil.

11. The artificial turf system of claim 10 wherein the base further comprises at least one of a plurality of stabilizing agents.

12. The artificial turf system of claim 11 wherein the stabilizing agent is selected from the group consisting of lime, fly ash, stone, and enzyme.

13. The artificial turf system of claim 1 wherein the turf assembly and base combination is substantially flat in order to provide a playing surface for a plurality of sporting activities.

14. A method for assembling a pre-engineered synthetic turf system comprising:

forming a base having a drainage system built in for draining fluids away from the pre-engineered synthetic turf system; and laying out a turf assembly upon the base such that fluids contacting the turf assembly pass into the drainage system of the base through various layers of the turf assembly, the various layers of the turf assembly including:

an impermeable moisture barrier layer disposed upon the base such that fluid passing through the turf assembly reaches the base in certain predetermined areas only;

a drainage layer disposed upon the moisture barrier layer that provides an open space for passage of fluid, the open space remaining open even when fluid is not passing therethrough;

a filtering layer disposed upon the drainage layer to prevent passage of undesirable particles in the fluid into the drainage layer; and an artificial turf layer having grass on an upper surface, the grass providing the turf assembly with an appearance of a completely natural playing field, the drainage layer providing support for the artificial turf layer such that the turf assembly has the feel of a completely natural playing field.

15. The method of claim 14 wherein the impermeable moisture barrier layer, the drainage layer, and the filtering layer are combined into a single unit that may be rolled out as a single layer.

16. The method of claim 15 wherein said laying out the turf assembly comprises:

rolling the single unit onto the base such that the base is completely covered with the single unit and fluid may flow to the base only through specific predetermined locations in the turf assembly; and rolling the artificial turf layer onto the single unit so that a field is formed that appears similar to a natural grass surface.

17. A pre-engineered synthetic turf system comprising:

a base having a drainage system built in for draining fluids away from the pre-engineered synthetic turf system; and a turf assembly disposed upon the base such that fluids contacting the turf assembly pass into the drainage system of the base through various layers of the turf assembly, the various layers of the turf assembly including:

an impermeable moisture barrier layer disposed upon the base such that fluid passing through the turf assembly reaches the base in certain predetermined areas only;

a drainage layer disposed upon the impermeable moisture barrier layer that provides an open space for passage of fluid, the open space remaining open even when fluid is not passing therethrough;

a filtering layer disposed upon the drainage layer to prevent passage of undesirable particles in the fluid into the drainage layer; and an artificial turf layer having grass on an upper surface, the grass providing the turf assembly with an appearance of a completely natural playing field, the drainage layer providing support for the artificial turf layer such that the turf assembly has the feel of a completely natural playing field.

18. The pre-engineered synthetic turf system of claim 17 wherein the base is formed as a smooth surface with a slightly curved cross section.

19. The pre-engineered synthetic turf system of claim 17 wherein the drainage layer comprises a solid plastic material that is shaped as a plurality of evenly distributed protrusions, each of the plurality of protrusions being of the same height.

20. The pre-engineered synthetic turf system of claim 17 wherein the drainage layer comprises a conglomeration of elongate plastic material that is distributed across the drainage layer such that the elongate plastic material provides the drainage layer with a uniform height across the pre-engineered synthetic turf system.

* * * * *